US005626417A

United States Patent [19]

McCavit

[11] Patent Number: 5,626,417

[45] Date of Patent: May 6, 1997

[54] MOTION DETECTOR ASSEMBLY FOR USE WITH A DECORATIVE COACH LAMP

[75] Inventor: Kim I. McCavit, St. Joseph, Mich.

[73] Assignee: Heath Company, Benton Harbor, Mich.

[21] Appl. No.: 632,676

[22] Filed: Apr. 16, 1996

[51] Int. Cl.[6] ..... F21V 23/00

[52] U.S. Cl. ..... 362/276; 362/394; 362/802; 250/353; 340/567

[58] Field of Search ..... 362/394, 276, 362/802, 395; 250/353, 342; 340/567

[56] References Cited

U.S. PATENT DOCUMENTS

| | | | |
|---|---|---|---|
| D. 206,082 | 10/1966 | Rosen | D26/87 |
| D. 298,417 | 11/1988 | Sund et al. | D10/40 |
| D. 313,668 | 1/1991 | Porter | D26/87 |
| D. 316,158 | 4/1991 | Choi | D26/87 |
| D. 316,759 | 5/1991 | Choi | D26/87 |
| D. 359,008 | 6/1995 | Sandell et al. | D10/106 |
| 3,524,180 | 8/1970 | Cruse | 340/258 |
| 3,551,684 | 12/1970 | Barton | 250/239 |
| 3,584,228 | 6/1971 | Kenyon et al. | 250/230 |
| 3,631,434 | 12/1971 | Schwartz | 340/228 |
| 3,703,718 | 11/1972 | Berman | 340/258 |
| 3,760,399 | 9/1973 | Schwarz | 340/258 D |
| 3,839,640 | 10/1974 | Rossin | 250/353 |
| 3,928,843 | 12/1975 | Sprout et al. | 340/258 D |
| 3,955,184 | 5/1976 | Cinzori et al. | 340/258 B |

(List continued on next page.)

FOREIGN PATENT DOCUMENTS

| | | |
|---|---|---|
| 0177130B1 | 3/1989 | European Pat. Off. . |
| 0234312B1 | 5/1991 | European Pat. Off. . |
| 3235250C2 | 3/1984 | Germany . |
| 3420188C2 | 4/1986 | Germany . |
| 8711135.7 | 3/1988 | Germany . |
| 3710561A1 | 10/1988 | Germany . |
| 4027347C2 | 9/1993 | Germany . |
| 61-292583 | 12/1986 | Japan . |
| 2162352 | 1/1986 | United Kingdom . |

OTHER PUBLICATIONS

Lathrop, Thomas G. and Lee A. Stevens, *Geometry—A Contemporary Approach*, Wadsworth Publishing Company, Inc., Belmont, California, Chapter 13, pp. 280–281, no publication date.

*Encyclopaedia of Mathematics*, vol. 2 C, An updated and annotated translation of the Soviet 'Mathematical Encyclopaedia', Kluwer Academic Publishers, Dordrecht/Boston/London, pp. 302–303 no publication date.

Lines, L., *Solid Geometry—With Chapters on Space–Lattices, Sphere–Packs and Crystals*, Dover Publications, Inc., New York, p. 4, no publication date.

ACE Promotional Material, Sales Literature re Motion Sensors, Oct. 1993.

ACE Promotional Material, Sales Literature re "Ace Brand" Motion Sensors, May 1995.

(List continued on next page.)

*Primary Examiner*—Stephen F. Husar

*Attorney, Agent, or Firm*—Fitch, Even, Tabin & Flannery

[57] ABSTRACT

A motion detector housing assembly is adapted to be integrated into a decorative coach lamp. The motion detector housing assembly includes a motion detector housing and a carrier assembly which may be configured in a manner to be similar to a decorative housing normally disposed on the top or bottom of the coach lamp assembly. The motion detector housing may be formed with upper and lower housing portions; together which form a generally frustro-conical configuration to match the configuration of a decorative housing disposed on the top or bottom of a lamp assembly. The lower housing portion is formed with an annular window. An important aspect of the invention is that the Fresnel lens member is configured in a generally cylindrical shape. As such, the optics of the system are improved and, in addition, decouples the lens design from the design of the lower housing portion. In order to protect the lens member a plastic lens cover is provided. The shape and size of the plastic cover is adapted to cover the window in the side wall of the lower housing portion.

9 Claims, 8 Drawing Sheets

U.S. PATENT DOCUMENTS

| | | | |
|---|---|---|---|
| 3,958,118 | 5/1976 | Schwarz | 250/221 |
| 3,988,726 | 10/1976 | Reiss et al. | 340/258 D |
| 4,023,035 | 5/1977 | Rodriguez | 250/239 |
| 4,024,397 | 5/1977 | Weiner | 250/338 |
| 4,052,616 | 10/1977 | Keller | 250/353 |
| 4,081,680 | 3/1978 | Keller | 250/342 |
| 4,214,165 | 7/1980 | Asawa | 250/338 |
| 4,218,620 | 8/1980 | Oettel | 250/338 |
| 4,225,786 | 9/1980 | Perlman | 250/342 |
| 4,238,675 | 12/1980 | Turlej et al. | 250/353 |
| 4,263,585 | 4/1981 | Schaefer | 340/567 |
| 4,268,752 | 5/1981 | Herwig et al. | 250/353 |
| 4,271,358 | 6/1981 | Schwarz | 250/338 |
| 4,275,303 | 6/1981 | Mudge | 250/342 |
| 4,284,888 | 8/1981 | Appleby | 250/338 |
| 4,302,674 | 11/1981 | Adachi et al. | 250/338 |
| 4,317,998 | 3/1982 | Dore | 250/347 |
| 4,321,594 | 3/1982 | Galvin et al. | 340/567 |
| 4,322,124 | 3/1982 | Padgitt et al. | 250/338 |
| 4,336,452 | 6/1982 | Baker | 250/338 |
| 4,367,408 | 1/1983 | Imai et al. | 250/338 |
| 4,375,034 | 2/1983 | Guscott | 250/342 |
| 4,377,808 | 3/1983 | Kao | 340/527 |
| 4,379,971 | 4/1983 | Smith et al. | 250/347 |
| 4,384,207 | 5/1983 | Doctor | 250/349 |
| 4,429,224 | 1/1984 | Wägli et al. | 250/342 |
| 4,437,002 | 3/1984 | Taniguchi et al. | 250/338 |
| 4,437,003 | 3/1984 | Doctor | 250/338 |
| 4,442,359 | 4/1984 | Lederer | 250/342 |
| 4,447,726 | 5/1984 | Mudge et al. | 250/342 |
| 4,451,734 | 5/1984 | St. Jean et al. | 250/342 |
| 4,529,874 | 7/1985 | Zierhut | 250/221 |
| 4,625,113 | 11/1986 | Zierhut | 250/338 |
| 4,626,687 | 12/1986 | Nara et al. | 250/338 |
| 4,651,144 | 3/1987 | Pagano | 340/693 |
| 4,703,171 | 10/1987 | Kahl et al. | 250/221 |
| 4,734,585 | 3/1988 | Owers | 250/353 |
| 4,757,204 | 7/1988 | Baldwin et al. | 250/342 |
| 4,768,020 | 8/1988 | Chen | 340/567 |
| 4,769,545 | 9/1988 | Fraden | 250/338 |
| 4,772,797 | 9/1988 | Kahl et al. | 250/353 |
| 4,778,996 | 10/1988 | Baldwin et al. | 250/353 |
| 4,787,722 | 11/1988 | Claytor | 350/452 |
| 4,799,243 | 1/1989 | Zepke | 377/6 |
| 4,800,278 | 1/1989 | Taniguti et al. | 250/338.1 |
| 4,823,051 | 4/1989 | Young | 315/155 |
| 4,841,284 | 6/1989 | Biersdorff | 340/567 |
| 4,882,567 | 11/1989 | Johnson | 340/522 |
| 4,890,093 | 12/1989 | Allison et al. | 340/567 |
| 4,930,864 | 6/1990 | Kuster et al. | 350/167 |
| 4,988,921 | 1/1991 | Ratner et al. | 315/159 |
| 5,015,994 | 5/1991 | Hoberman et al. | 340/567 |
| 5,066,855 | 11/1991 | Lee | 250/221 |
| 5,089,704 | 2/1992 | Perkins | 250/342 |
| 5,103,346 | 4/1992 | Chang | 359/885 |
| 5,121,287 | 6/1992 | Lee | 362/95 |
| 5,124,546 | 6/1992 | Hu | 250/216 |
| 5,128,654 | 7/1992 | Griffin et al. | 340/567 |
| 5,187,360 | 2/1993 | Pasco | 250/208.2 |
| 5,200,624 | 4/1993 | Pederson, Jr. et al. | 250/353 |
| 5,217,296 | 6/1993 | Tanner et al. | 362/183 |
| 5,221,919 | 6/1993 | Hermans | 340/567 |
| 5,243,508 | 9/1993 | Ewing et al. | 362/431 |
| 5,258,899 | 11/1993 | Chen | 362/394 |
| 5,266,807 | 11/1993 | Neiger | 250/353 |
| 5,282,118 | 1/1994 | Lee | 362/276 |
| 5,291,020 | 3/1994 | Lee | 250/342 |
| 5,308,985 | 5/1994 | Lee | 250/353 |
| 5,309,145 | 5/1994 | Branch et al. | 340/540 |
| 5,309,147 | 5/1994 | Lee et al. | 340/567 |
| 5,381,011 | 1/1995 | Sandell et al. | 250/353 |
| 5,381,323 | 1/1995 | Osteen et al. | 362/276 |
| 5,386,210 | 1/1995 | Lee | 340/567 |
| 5,406,083 | 4/1995 | Sandell et al. | 250/353 |
| 5,418,368 | 5/1995 | Sandell et al. | 250/353 |
| 5,434,764 | 7/1995 | Lee et al. | 362/276 |
| 5,442,132 | 8/1995 | Sandell et al. | 174/48 |

OTHER PUBLICATIONS

Catalina Promotional Literature, Passive Infrared Security Solid Brass Outdoor Lanterns, no publication date.

The Designers Edge Promotional Literature, Solid Brass Outdoor Lanterns, Model #L–2773/L–2772, Aug. 1994.

Gentech Promotional Literature, Passive Infrared Sensor Lamps, no publication date.

Intelectron Promotional Literature, Solid Brass Motion Detector Decorative Lantern, Model BC925 Series, 1994.

Intelectron Promotional Literature, Motion Detector High Dome Style Lantern, Model BC920 Series, no publication date.

Intelectron Promotional Literature, Motion Detector Estate Lantern, Model BC974 Series, no publication date.

Intelectron Promotional Literature, Motion Detector Lighting—Combining Security With Style, no publication date.

Intelectron Promotional Literature, Motion Detector Product Features, no publication date.

Intelectron Promotional Literature, Wireless Motion Detection Security Lighting, no publication date.

Intelectron Promotional Literature, Motion Activated Solid Brass Coach Lamp, Model BC900PB, no publication date.

Intelectron Promotional Literature, Motion Detector Mounting Plate Conversion Kit, no publication date.

Intelectron Promotion Literature, Solid Brass Coach Lamp With Built–In Motion Detector, Models BC910PB, BC910BK, no publication date.

Intelectron Promotional Literature, Solid Brass Estate Lantern With Built–In Motion Detector, Models BC964PB, BC964AB, BC964WT, BC964BK, no publication date.

Heath Zenith Promotional Literature, Reflex Motion Sensing Coach Light, Model SL–4120 Series, no publication date.

Heath Zenith Promotional Literature, Reflex Motion Sensing Solid Brass Lantern, Model SL–4130 Series, no publication date.

Heath Zenith Promotional Literature, Reflex Decorative Globe Outdoor Motion Sensor Light, Model SL–4140 Series, no publication date.

Heath Zenith Promotional Literature, Reflex Solid Brass Coach Light With Motion Detection, Model SL–4150 Series, Jul. 1994.

Heath Zenith Promotional Literature, Reflex Solid Brass Lantern With Motion Sensor, Model SL–4160 Series, Jul. 1994.

Heath Zenith Promotional Literature, Reflex Solid Brass Carriage Light With Motion Detection, Model SL–4170 Series, Jul. 1994.

Heath Zenith Promotional Literature, Motion Sensor Decorative Lighting Control, Model SL–5210 Series, no publication date.

Heath Zenith Promotional Literature, Reflex Instant Motion Sensor Light Control, Model SL–5211, 1990.

Heath Zenith Promotional Literature, Reflex Standards for Motion Sensors and Lights, 1994.

Pittway Corporation Promotional Literature, First Alert Sensor Switch, Automatic Outdoor Light Control, Model PIR740, Aug. 1987.
RCA Promotional Literature, The RCA Security Switch, Models C–24, C–21 and C–23, no publication date.
RCA Promotional Literature, Stop Intruders!, The RCA Security Switch, no publication date.
Regent Lighting Co. Promotional Literature, The Classic Nite–Watch With Motion Detector, Model RL30/BC, no publication date.
Regent Lighting Co. Promotional Literature, Motion Activated Coach Lanterns, Models RL30/BC, RL35/B, no publication date.
Regent Lighting Co. Promotional Literature, Motion Activated Solid Brass Carriage Lantern, Model MBL17HW Series, no publication date.
EverSpring Promotional Literature, ES42 Halogen Light Control, no publication date.
EverSpring Promotional Literature, ES34, ES46 Light Control, no publication date.
EverSpring Promotional Literature, ES37 Light Control, no publication date.
EverSpring Promotional Literature, ES43 Mini Alarm, no publication date.
EverSpring Promotional Literature, ES47 Wall Switch, no publication date.
EverSpring Promotional Literature, ES49 Global Auto–Lamp, no publication date.
EverSpring Promotional Literature, ES65 Mini Halogen Light, no publication date.
EverSpring Promotional Literature, ES63 Halogen Light Control, no publication date.
EverSpring Promotional Literature, ES34, ES37, ES46, ES60, no publication date.
EverSpring Promotional Literature, ES47, ES49, ES61, ES33, ES41, ES42, no publication date.
EverSpring Promotional Literature, ES41 Convenient Light Control, no publication date.
EverSpring Promotional Literature, Accessories, no publication date.
EverSpring Promotional Literature, Light Control System, no publication date.
EverSpring Promotional Literature, HA–53U and SA–230, Oct. 1993.
EverSpring Promotional Literature, HA–50 and HA–50M, no publication date.
EverSpring Promotional Literature, HA–53U Starter Kit, no publication date.
EverSpring Promotional Literature, HA25 PIR Sentry, no publication date.
EverSpring Promotional Literature, HA29 Burglar Alarm Control, no publication.
EverSpring Promotional Literature, SA215, SA217, no publication date.
EverSpring Promotional Literature, Accesories SA100–SA229, no publication date.
Woods Wire Products, Inc. Promotional Literature, Lights On! Remote Motion Activated Safety Lighting Kits and Accessories, 1989.
Woods Wire Products, Inc. Promotional Literature, Coach Light Motion Detector, no publication date.
EverSpring Promotional Literature, Light Control ES62, no publication date.

MOTION DETECTOR ASSEMBLY FOR USE WITH A DECORATIVE COACH LAMP

BACKGROUND OF THE INVENTION

1. Field of the Invention

The present invention relates to a motion detector assembly that is adapted to be integrated into a decorative coach lantern and more particularly to a motion detector assembly that includes a housing and a sensor carrier subassembly which includes a passive infrared (PIR) sensor and a Fresnel lens, the Fresnel lens being configured in a cylindrical section and disposed generally parallel to a longitudinal axis of the assembly to provide improved optics, such as improved gain and reduced aberrations.

2. Description of the Prior Art

Decorative coach lamps with integral motion sensors are relatively well known in the art. Examples of such decorative coach lamps are disclosed in U.S. Pat. Nos. 5,282,118 and 5,434,764. In such decorative coach lanterns, the motion detector, normally a passive infrared (PIR) sensor, is carried by a housing, rigidly disposed beneath a lamp assembly and configured to blend aesthetically with the overall appearance of the coach lamp. In both the '118 and the '764 patents, the motion detector housing is formed with an upper housing portion and a lower housing portion which when assembled together resemble a decorative housing, rigidly carried on the top or bottom of the lamp assembly.

The lower housing portion of such a motion detector housing is formed in either a convex as disclosed in the '118 patent or a conical shape as disclosed in the '764 patent and includes an annular window, aligned with the sensor within the housing. A multi-faceted Fresnel lens, used to focus the infrared radiation on the PIR sensor, is secured to the annular window. As such, the surface of the Fresnel lens is generally configured in a conical or convex shape. Requiring the Fresnel lens to conform to the shape of the annular opening limits the flexibility of the optical design and can result in reduced performance. Moreover, the design of the Fresnel lens in such a configuration is dependent upon the configuration of the housing.

There are other problems with utilizing motion detector housing assemblies having a Fresnel lens configured in a conical shape as disclosed in the '764 patent or a convex shape as disclosed in the '118 patent. In particular, with configurations such as disclosed in the '118 and '764 patents, it is known that such configurations can cause aberrations which, in turn, decrease the overall gain of the sensor. Furthermore, the '118 patent discloses a convexo-convex type housing for the PIR sensor which requires a Fresnel lens to be formed in a convex shape with curvature along two directions in order to seat against the annular window in the lower housing portion. Such a Fresnel lens would be relatively difficult to manufacture and certainly expensive, thereby driving up the cost of the entire decorative coach lamp assembly.

SUMMARY OFT HE INVENTION

It is an object of the present invention to solve various problems in the prior art.

It is yet another object of the present invention to provide a motion detector assembly that is adapted to be integrated with a decorative coach lamp.

It is yet another object of the present invention to provide a motion detector assembly which includes a passive infrared sensor (PIR) and a Fresnel lens wherein the design of the Fresnel lens is not dependent upon the configuration of the motion detector housing.

Briefly, the present invention relates to a motion detector assembly that is adapted to be integrated into a decorative coach lantern. The motion detector assembly is configured to be a decorative housing disposed on the top or bottom of the coach lamp and includes a motion detector housing and a sensor carrier subassembly. The motion detector housing may be formed with upper and lower generally frustro-conical housing portions; together which form a decorative housing disposed on the top or bottom of the coach lamp assembly. The lower housing portion of the motion detector housing is formed with an annular window. An important aspect of the invention is that the Fresnel lens member is configured in a generally cylindrical shape. As such, the optics of the system are improved and, in addition, makes the design of the Fresnel lens independent of the configuration of the motion detector housing. In order to protect the lens, a lens cover may be rigidly secured to the sensor carrier subassembly. The lens cover is aligned with the annular window in the lower housing portion of the motion detector housing.

BRIEF DESCRIPTION OF THE DRAWING

These and other objects of the present invention will be readily understood with reference to the following specification and attached drawing, wherein.

DETAILED DESCRIPTION OFT HE INVENTION

Figure 1:
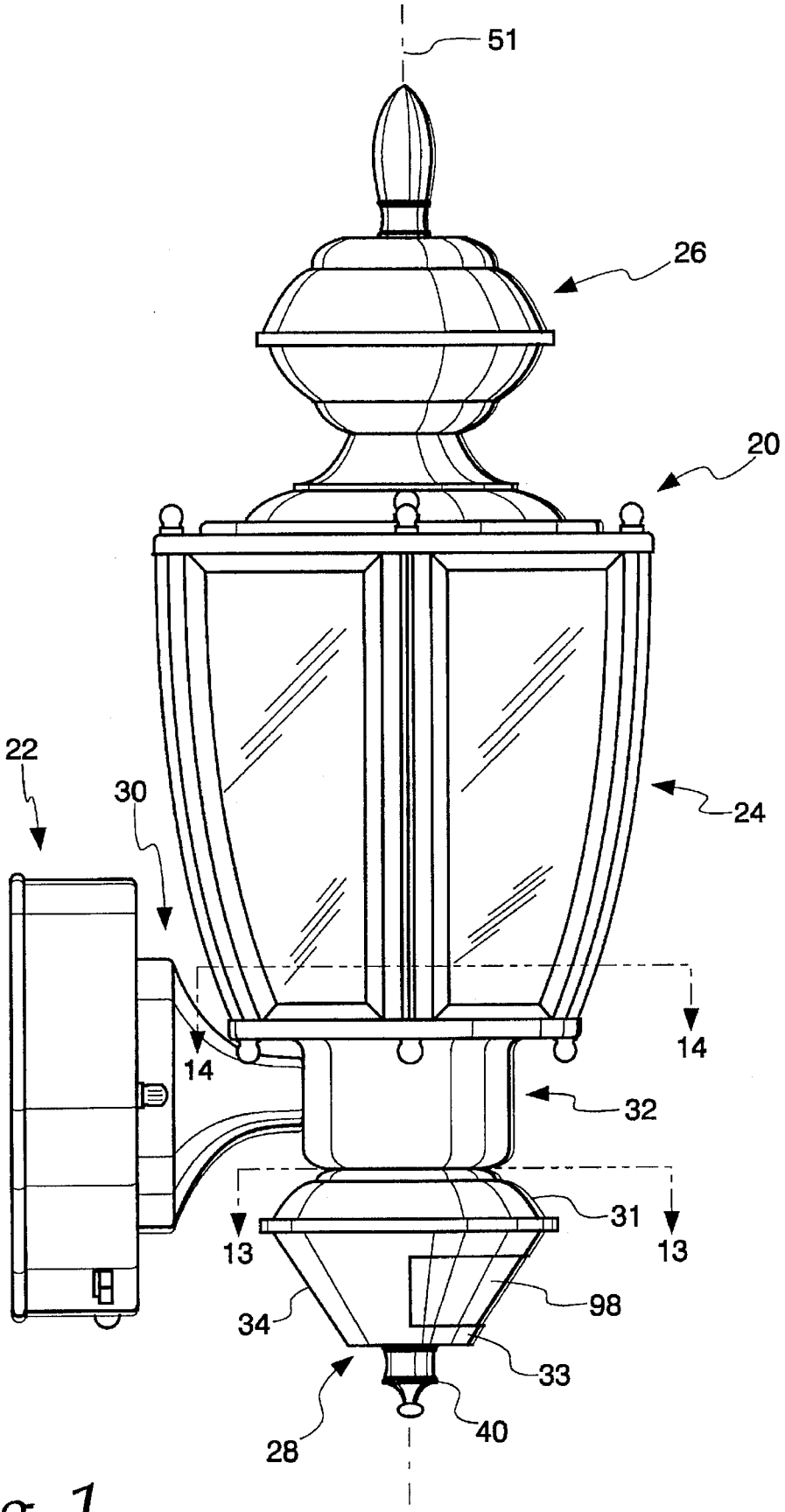
FIG. 1 is an elevational view of a decorative coach lamp, illustrating a motion detector assembly in accordance with the present invention.

A decorative coach lantern, adapted to utilize the motion detector assembly in accordance with the present invention, is illustrated in FIG. 1. The decorative coach lamp, generally identified with the reference numeral 20, generally includes a base assembly 22, a lamp assembly 24, an upper decorative housing 26, and a motion detector assembly 28, normally secured to the bottom of the lamp assembly 24.

Such decorative coach lanterns 20 normally include a passive infrared (PIR) sensor 29 (FIG. 18), disposed within the motion detector housing 28 to detect moving sources of infrared radiation. Upon detection of moving sources of infrared radiation, a lamp (not shown) within the lamp assembly 24 is illuminated usually for a predetermined time period. After the source of moving radiation is removed, the lamp normally returns to an off state.

Figure 2:
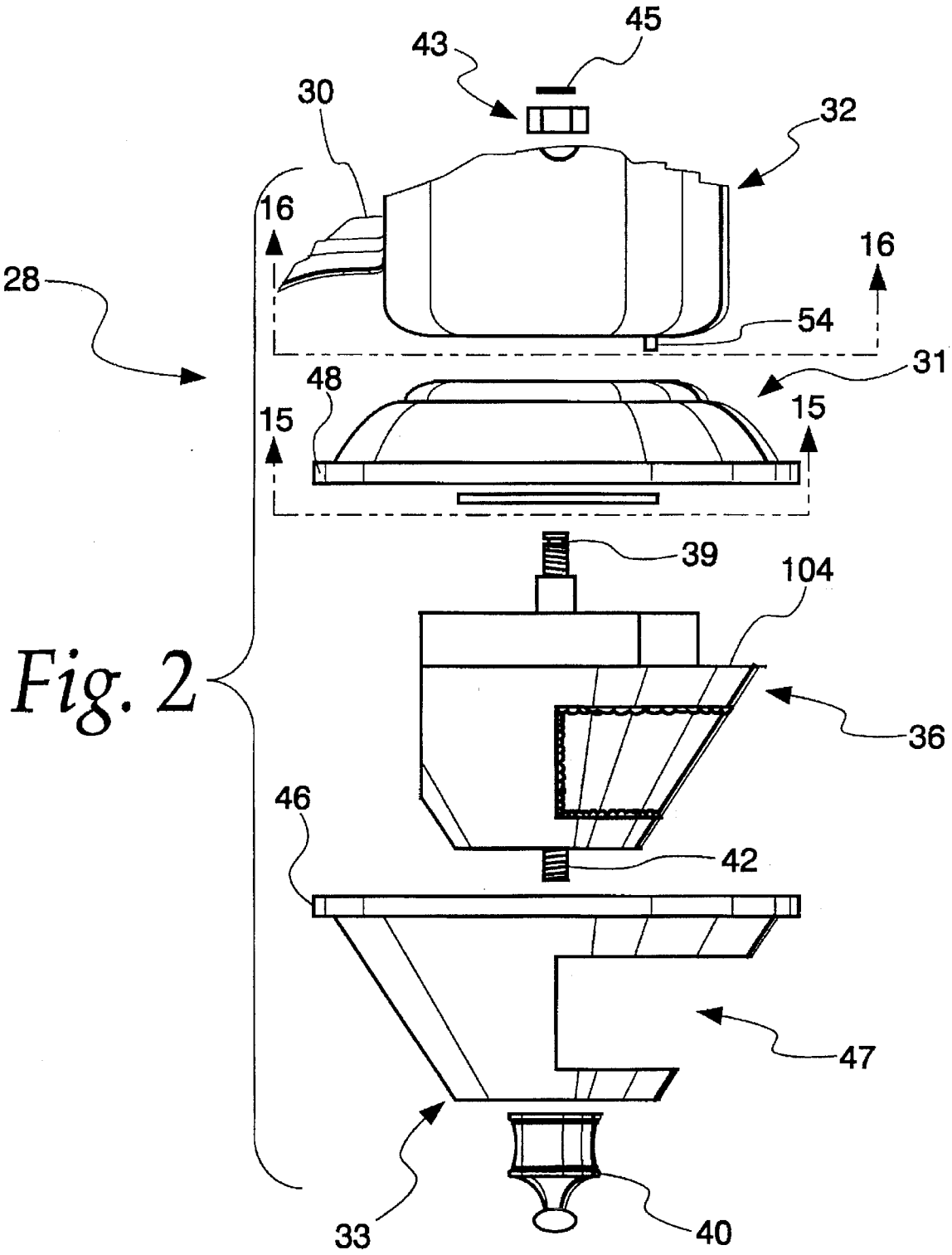
FIG. 2 is an exploded elevational view of the motion detector assembly shown in FIG. 1, illustrating a motion detector housing and a sensor carrier subassembly which form the motion detector assembly in accordance with the present invention.
Figure 14:
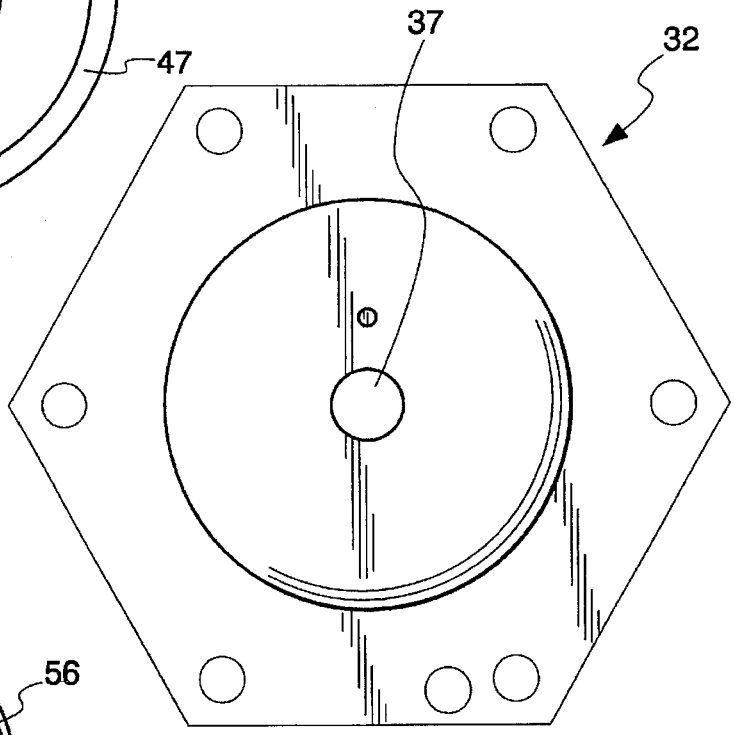
FIG. 14 is a section view along line 14—14 of FIG. 1.

As shown best in FIGS. 1 and 2, the base assembly 22 includes a pendant portion 30 that attaches directly to an annular housing portion 32 (FIGS. 1 and 14) of the lamp assembly 24. The pendant portion 30 (FIG. 1) acts as a conduit for electrical connectors (not shown) which extend from the lamp assembly 24 to the base assembly 22 for connection to an external electrical circuit (not shown). In particular, the electrical conductors extend from the base assembly 22 through the pendant portion 30 and into the lamp assembly 24. These conductors are adapted to be connected with electrical conductors (not shown) from the motion detector assembly 28 in a known manner to function in a manner as discussed above.

The motion detector assembly 28 in accordance with the present invention includes a motion detector housing 34 and a sensor carrier subassembly 36 (FIG. 2). The motion detector housing 34 may be formed in two parts, including an upper housing portion 31 and a lower housing portion 33 and rigidly attached below the lamp assembly 24 as shown in FIG. 1.

As shown in FIG. 2, the upper housing portion 31 is formed in a generally convex shape, which generally conforms to the shape of a decorative housing 26 (FIG. 1), shown rigidly secured to the top of the lamp assembly 24. The upper housing section 31 is provided with a centrally disposed aperture 35 (FIG. 13), adapted to be aligned with a centrally disposed aperture 37 (FIG. 14) in the annular housing portion 32 of the lamp assembly 24. The apertures 35 and 37 are adapted to receive an upper threaded stud 39 (FIG. 2), carried by sensor carrier subassembly 36. The upper threaded stud 39 is provided with a central bore 41 (FIG. 13) to enable wiring from the PIR sensor 29 (FIG. 18) and associated circuitry to be wired into the lamp assembly 24. The upper threaded stud 39 is also used to enable the sensor carrier subassembly 36 and the upper housing portion 31 to be secured to the annular housing portion 32 of the lamp assembly 24 by way of a nut 43 (FIG. 2) and retaining ring 45.

Figure 10:
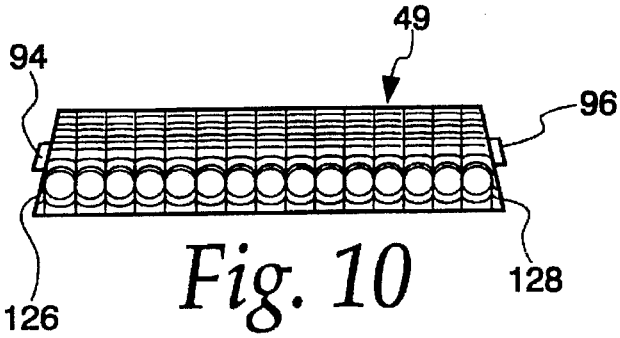
FIG. 10 is a plan view of a Fresnel lens member for use with the present invention.

The lower housing portion 33 of the motion detector housing 34 is also shown in FIG. 2. As shown, the lower housing portion 33 is formed in a generally frustro-conical shape with an annular aperture or window 47 that may extend around 180°. An important aspect of the present invention is that a Fresnel lens member 49 (FIG. 10), which focuses the infrared radiation onto the (PIR) sensor 29 (FIG. 18), is not secured to the annular window 47 (FIG. 2). Rather, as will be discussed in more detail below, the Fresnel lens member 49 is disposed in a generally cylindrical configuration generally concentric to a longitudinal axis 51 (FIG. 1) of the lamp 20.

A centrally disposed aperture (not shown) may be provided in the lower housing portion 33 to enable a decorative knob 40 (FIGS. 1 and 2) with a centrally disposed threaded bore (not shown) or tail assembly (not shown) to be rigidly attached thereto. More particularly, the threaded bore is sized to receive a threaded stud 42 (FIG. 2), carried by the sensor carrier subassembly 36. When the sensor carrier subassembly 36 is received in the centrally disposed aperture in the lower housing portion 33, the stud 42 protrudes downwardly to enable a decorative threaded knob 42 or tail assembly (not shown) to be attached, thereby securing the lower housing portion 33 to the sensor carrier subassembly 36.

The lower housing portion 33 of the motion detector housing 34 may be formed with an annular lip 46 (FIG. 2). The annular lip 46 may be configured with a diameter slightly smaller than the diameter of an annular lip 48 provided on the upper housing portion 31 of the motion detector housing 34, to enable the upper and lower housing portions 31 and 33 to be coaxially aligned and captured relative to one another.

Figure 19:
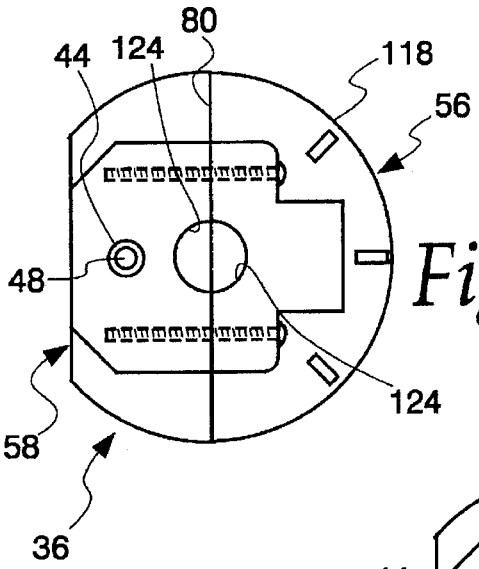
FIG. 19 is a top plan view of the sensor carrier subassembly in accordance with the present invention.

In one embodiment of the invention, rotation of the sensor carrier subassembly 38 may be precluded relative to the upper housing portion 31 of the motion detector housing 34. More particularly, with reference to FIGS. 17 and 19, the motion detector subassembly 34 is formed with an extending boss 44 which extends upwardly and includes a central bore 48 (FIG. 19). The boss 44 is adapted to receive a pin 50 (FIG. 13) which extends downwardly (i.e. into the plane of page relative to FIG. 13) from the upper housing portion 31 of the motion detector housing 34 to properly align the sensor carrier subassembly 36 with the annular window 47 (FIG. 2) in the lower housing portion 33 as well as prevent rotation of the sensor carrier subassembly 36 relative to the upper housing portion 31.

Figure 13:
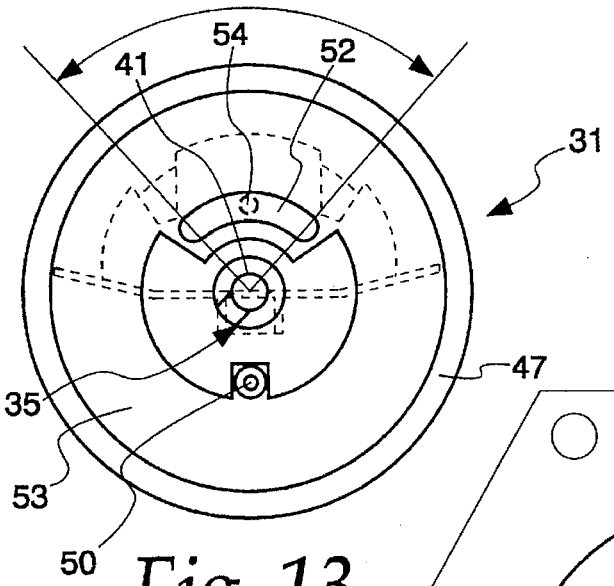
FIG. 13 is a section view along line 13—13 of FIG. 1.

Referring to FIGS. 2 and 13, a limited amount of rotation may be provided between the motion detector assembly 28 and the annular housing portion 32 of the lamp assembly 24 to enable the field of view of the motion detector assembly 28 to be rotatably adjusted. In particular, an arcuate channel 52 (FIG. 13) may be formed on a top surface 53 of the upper housing portion 31. As shown in FIG. 13, the arcuate channel 52 may be configured to provide about 90° rotation of the motion detector assembly 28 relative to the lamp assembly 24. As shown in FIG. 2, a pin 54 extends downwardly from the annular housing portion 32 of the lamp assembly 24. This pin 54 is received in the arcuate channel 52 (FIG. 13) to limit the rotation of the motion detector assembly 28 relative to the lamp assembly 24 as a function of the arcuate length of the arcuate channel 54. Sufficient slack is provided in the electrical conductors between the motion detector assembly 28 and the lamp assembly 24 to permit such rotation without damaging the electrical conductors or affecting any of the electrical connections.

Figure 18:
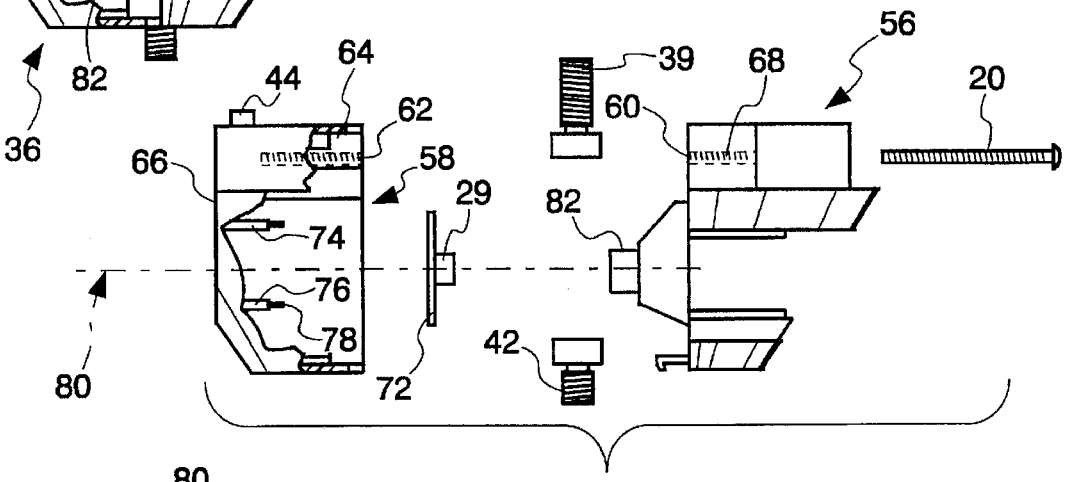
FIG. 18 is similar to FIG. 17 but showing the sensor carrier subassembly disassembled.

The sensor carrier subassembly 36 is generally configured to fit within the motion detector housing As shown in FIGS. 12, 16, 18 and 20, the sensor carrier subassembly 36 may be formed in two portions, for example, a front portion 56 (FIG. 16) for carrying the Fresnel lens member 49 (FIG. 10) in a generally cylindrical configuration and may be disposed generally concentric relative to the longitudinal axis 51 (FIG. 1) and a rear portion 58 for carrying the PIR sensor 29 (FIG. 18). Both the front and rear portions 56 and 58 are formed with confronting surfaces 60 (FIG. 16) and 62, respectively, and joined at a parting line 80 (FIG. 19). Various conventional methods may be used to join the front and rear sections 56 and 58, respectively. For example, in one embodiment, the rear portion 58 (FIG. 18) may be formed with threaded stand-offs 64, generally perpendicular to a rear wall 66 of the rear portion 58 of the sensor carrier subassembly 36. These stand-offs 64 are adapted to be aligned with bores 68 formed in the front portion 56 of the sensor carrier subassembly 38 and receive threaded fasteners 70 to secure the front and rear portions 56 and 58 to one another. In addition to the fasteners 70, the front and rear portions 56 and 58 may be fastened together by way of a suitable epoxy, applied to the confronting surfaces 60 and 62.

As best shown in FIG. 18, the rear portion 58 of the sensor carrier subassembly 36 is used to carry a printed circuit board 72, which, in turn carries the PIR sensor 29 and related conventional circuitry. The printed circuit board 72 may be provided with one or more apertures (not shown) to enable the printed circuit board 72 to be rigidly secured to the inside of the rear wall 66 of the rear portion 58 by way of one or more heat stakes 74, which extend generally perpendicular from the rear wall 66. Once the heat stakes 74 are received in the apertures in the printed circuit board 72, the tips 78 of the heat stakes 74, 76 are heated to melt the ends to rigidly secure the printed circuit board 72 relative to the rear portion 58 of the sensor carrier subassembly 36.

Figure 17:
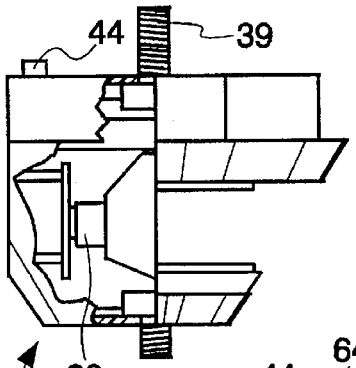
FIG. 17 is an elevational view of the sensor carrier subassembly in accordance with the present invention, partially in section.
Figure 20:
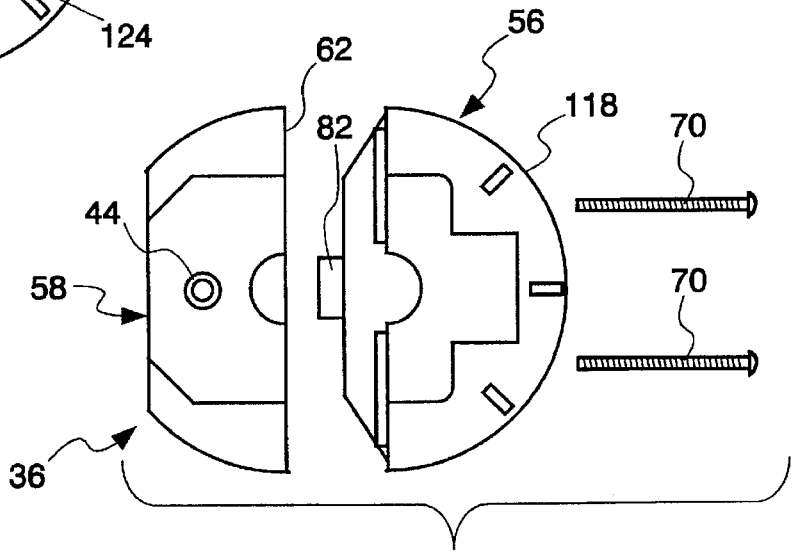
FIG. 20 is similar to FIG. 19 but shown disassembled.

As best shown in FIGS. 17, 18 and 20, the front portion 56 of the sensor carrier subassembly 38 includes a tube 82 that is adapted to be disposed around the PIR sensor 29. The tube 82 is open at one end. A generally square or rectangular aperture 82 (FIG. 9) is disposed in a rear wall 84 of the front portion 76 of the sensor carrier subassembly 36 at the other end of the tube 82 to establish a viewing window for the PIR sensor 29. In particular, with such a configuration, the plane of the aperture 82 (FIG. 9) is generally parallel to a viewing field of the PIR sensor 29; the viewing field being generally perpendicular to a transverse axis 80 (FIG. 18), which, in turn, is generally perpendicular to the longitudinal axis 51 (FIG. 1).

Figure 9:
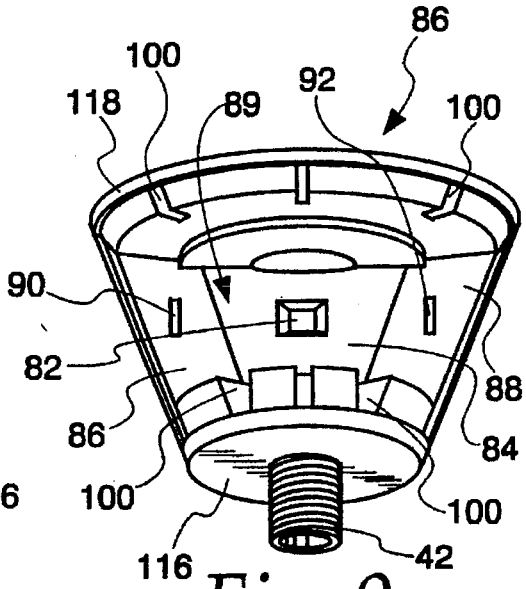
FIG. 9 is a perspective view of the sensor carrier subassembly in accordance with the present invention.
Figure 11:
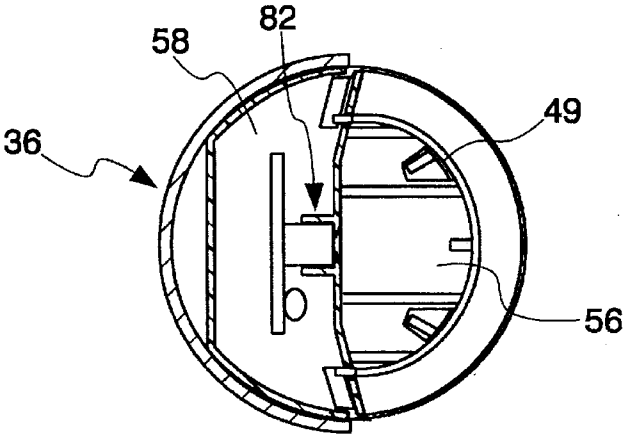
FIG. 11 is a plan view of the sensor carrier assembly, shown with the Fresnel lens member and lens cover assembled together.
Figure 12:
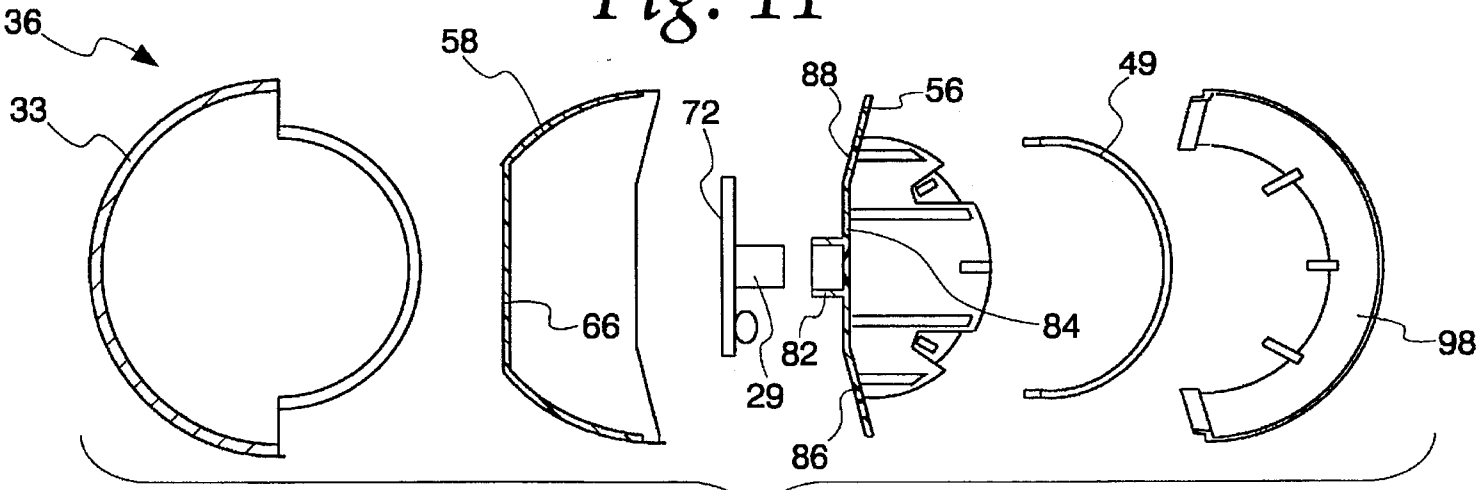
FIG. 12 is an exploded plan view of the sensor carrier subassembly illustrated in FIG. 11.

Referring to FIGS. 9, 11 and 12, the configuration of the front portion 56 of the sensor carrier subassembly 36 includes the rear wall 84 with two depending wing portions 86 and 88, which, as best shown in FIGS. 11 and 12, span slightly less than 180°, define an open arcuate area, generally identified with the reference numeral 89 (FIG. 9). A pair of slots 90 and 92 (FIG. 9) are formed in the depending wing portions 86 and 88, respectively. These slots 90 and 92 are adapted to receive cooperating tabs 94 and 96 (FIG. 10) formed on the ends of the Fresnel lens member 49 to secure the Fresnel lens member 49 to the front housing portion 56 in a generally cylindrical shape and may be disposed generally concentric relative to the longitudinal axis 51 (FIG. 1) as best shown in FIG. 11, which causes the Fresnel lens member 49 to be disposed generally parallel to the longitudinal axis 51 (FIG. 1) all along its radius, as well as centrally disposed relative to the aperture 82 (FIG. 9) in the front portion 46 of the sensor carrier subassembly 36.

Figure 3:
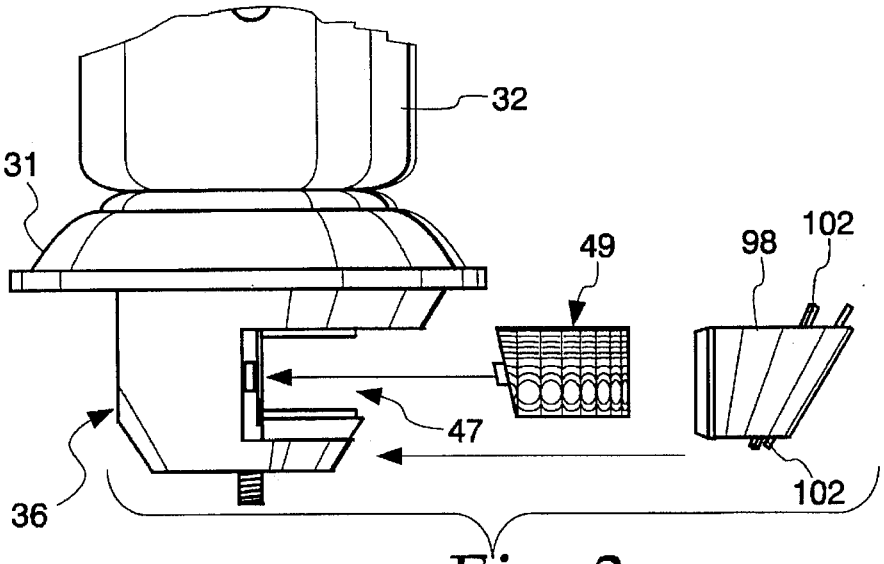
FIG. 3 is an exploded view of the motion detector assembly with a lower portion of the motion detector housing removed showing the assembly of a Fresnel lens member and a lens cover.
Figure 4:
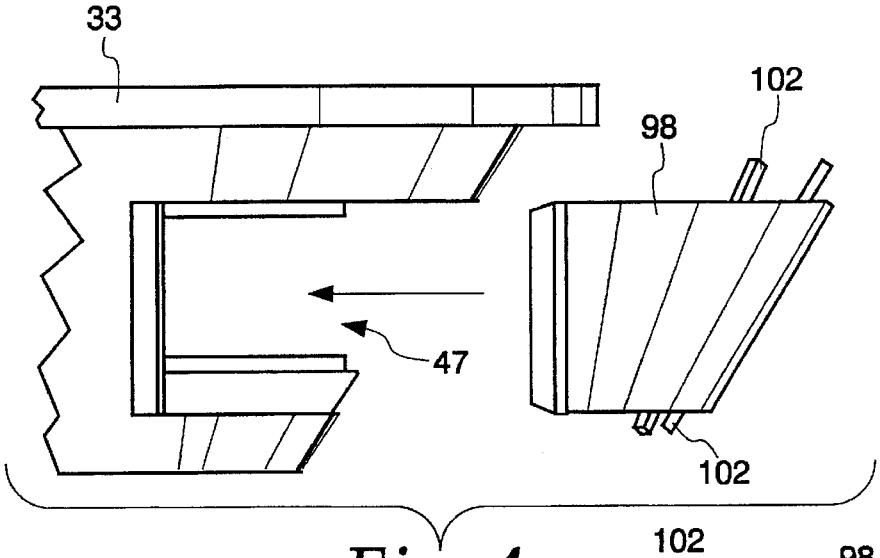
FIG. 4 is a partial elevational view of the sensor carrier subassembly in accordance with the present invention, shown without the Fresnel lens member and with the lens cover removed.
Figure 5:
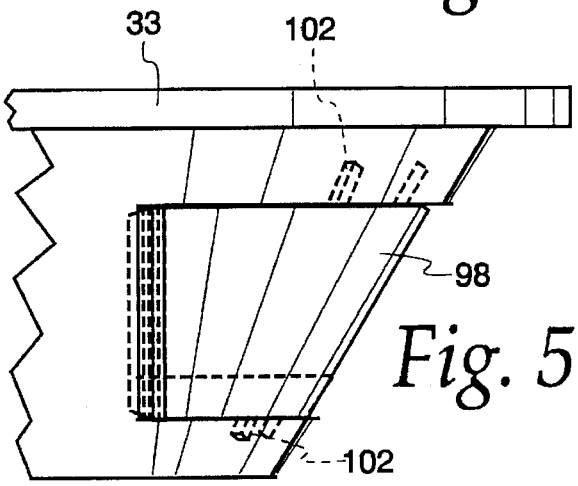
FIG. 5 is similar to FIG. 6, but shown with the lens cover installed.
Figure 6:
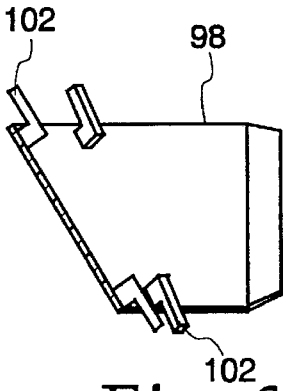
FIG. 6 is a perspective view of the lens cover that may be rigidly secured to the sensor carrier subassembly illustrated in FIGS. 3 and 4.

In order to protect the Fresnel lens member 49 and the PIR sensor 29 from environmental effects, a lens cover 98 (FIG. 4) may be secured to the sensor carrier subassembly 36. More particularly, referring to FIG. 9, the front portion 56 of the sensor carrier subassembly 36 includes a plurality of radially disposed slots 100 along the top and bottom portions of the carrier subassembly 36. These slots 100 are adapted to receive extending tabs 102 (FIG. 4) formed along the edges of the lens cover 98. As shown in FIGS. 3–5, the Fresnel lens member 49 is inserted as described above. Subsequently, the tabs 102 formed in the lens cover 98 are inserted to the cooperating radial slots 100 in the sensor carrier subassembly 36. After the lens cover 98 is mechanically secured relative to the sensor carrier subassembly 36, a coating of a suitable adhesive 104 (FIG. 2), such as silicon rubber, may be used to further secure the lens cover 98 to the sensor carrier subassembly 36. The lower housing portion 33 of the motion detector housing 34 is then oriented such that the annular window 47 (FIG. 2) is aligned with the lens cover 98. The lower housing portion 33 is subsequently secured to the sensor carrier subassembly 36 in a manner as discussed above.

Figure 15:
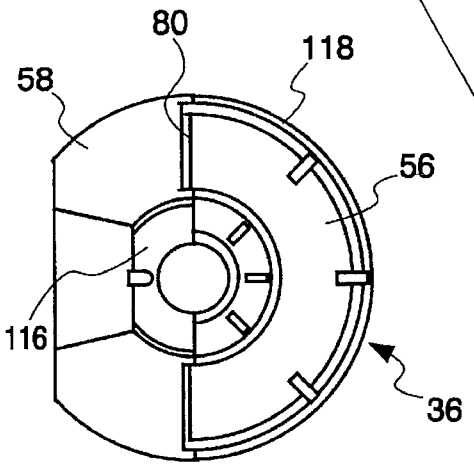
FIG. 15 is a bottom plan view of the sensor carrier subassembly in accordance with the present invention.
Figure 16:
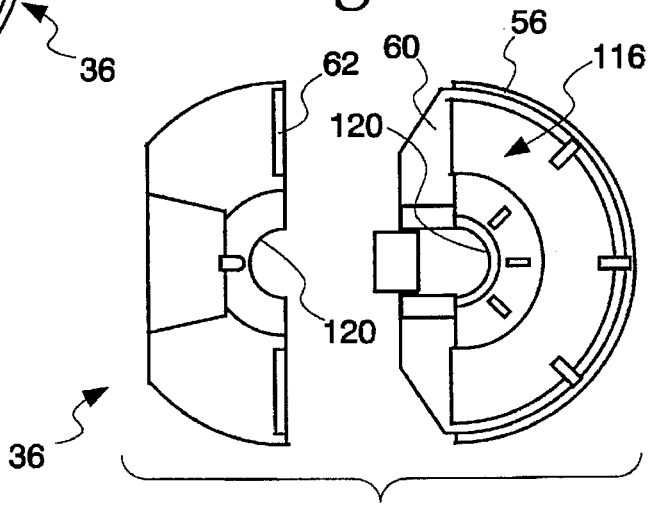
FIG. 16 is similar to FIG. 15 but showing the sensor carrier subassembly disassembled.

As mentioned above, the sensor carrier subassembly 36 is formed in two parts 56 and 58, secured together with a suitable adhesive along the break line 80 (FIG. 15). The shape of the sensor carrier assembly 36 when assembled, is generally conical in shape, as best shown in FIG. 2, and adapted to fit within the lower housing portion 33. Referring to FIGS. 9 and 15, when assembled, the sensor carrier subassembly 36 is formed with a bottom generally circular disk portion 116 (FIG. 15) and a concentrically aligned upper, circular disk portion 118, having different diameters. The upper and lower disk portions 118 and 116, respectively, are disposed concentric with respect to one another, thus defining a generally conical shape for the sensor carrier subassembly 36.

As mentioned above, the sensor carrier subassembly 36 carries a pair of studs 39 and 42 (FIG. 2). The stud 39 is carried by forming the bottom disk 116 with confronting semi-circular notches 120 (FIG. 16) which, when assembled together, are slightly larger than an annular indented notch (not shown) formed in the stud 39. Similarly, the upper disk 118 is formed with a pair of confronting semi-circular notices 124 (FIG. 19), which form a circle having a diameter slightly larger than the annular indented notch in the stud 42. As such, when the front and rear portions 56 and 58, respectively, of the sensor carrier subassembly 36 are assembled together, the studs 39 and 42 are captured and coaxially aligned.

The Fresnel lens member 49 (FIG. 10) may be formed from a generally planar material and simply bent to enable the tabs 94 and 96 to be received in the slots 90 and 92 (FIG. 9) in the sensor carrier subassembly 36, which configures the Fresnel lens member in a generally cylindrical section, disposed generally concentric relative to the longitudinal axis 51 (FIG. 1) of the motion detector assembly 28. The Fresnel lens member is generally rectangular with its opposing ends 126 and 128 cut a slight angle to butt against the depending wing portions 86 and 88.

Figure 7:
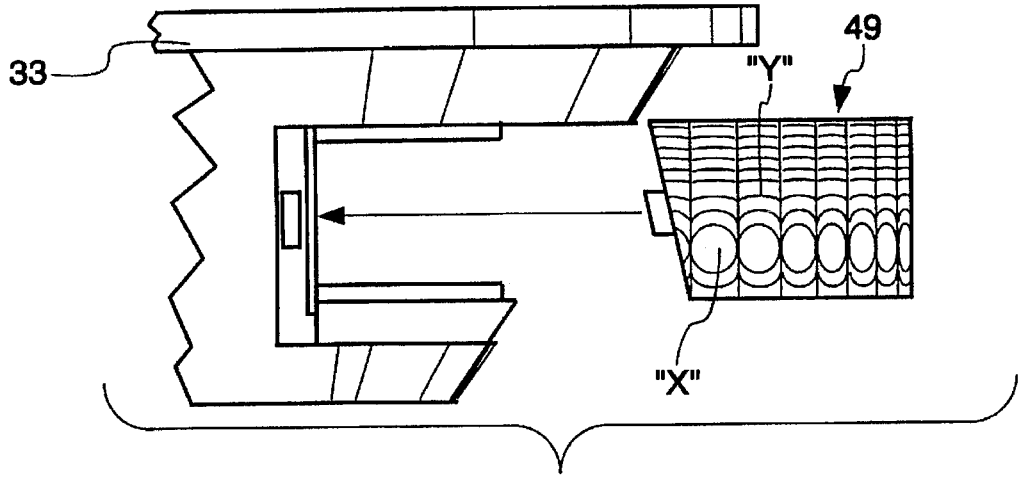
FIG. 7 is a partial elevational view of the sensor carrier subassembly in accordance with the present invention, shown without the lens cover and with the lens member removed.
Figure 8:
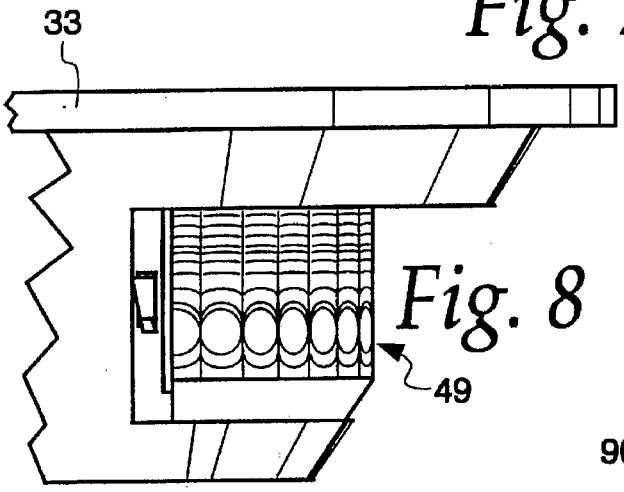
FIG. 8 is similar to FIG. 8, shown with the Fresnel lens member installed.

The Fresnel lens member 49 may be fabricated from a larger lens such as can be purchased from Ching Tien Industry Co., Ltd. in Taiwan as part number X2335118. The larger lens may be cut such that when installed it will form a nearly cylindrical section. Further, the larger lens may be cut such that the optical centers ("X", FIG. 7) of the individual Fresnel sections or individual sections ("Y", FIG. 7) are arranged relative to the center of the PIR sensor 29 (FIG. 18) such that the angle of the motion detection field above or below horizontal can be controlled.

As will be recognized to those skilled in the art, many design variations are possible for the lens 49. By selecting the number, arrangement, and size of the individual Fresnel lenses Y (FIG. 7), motion detection fields may be established to meet various needs.

Figure 21:
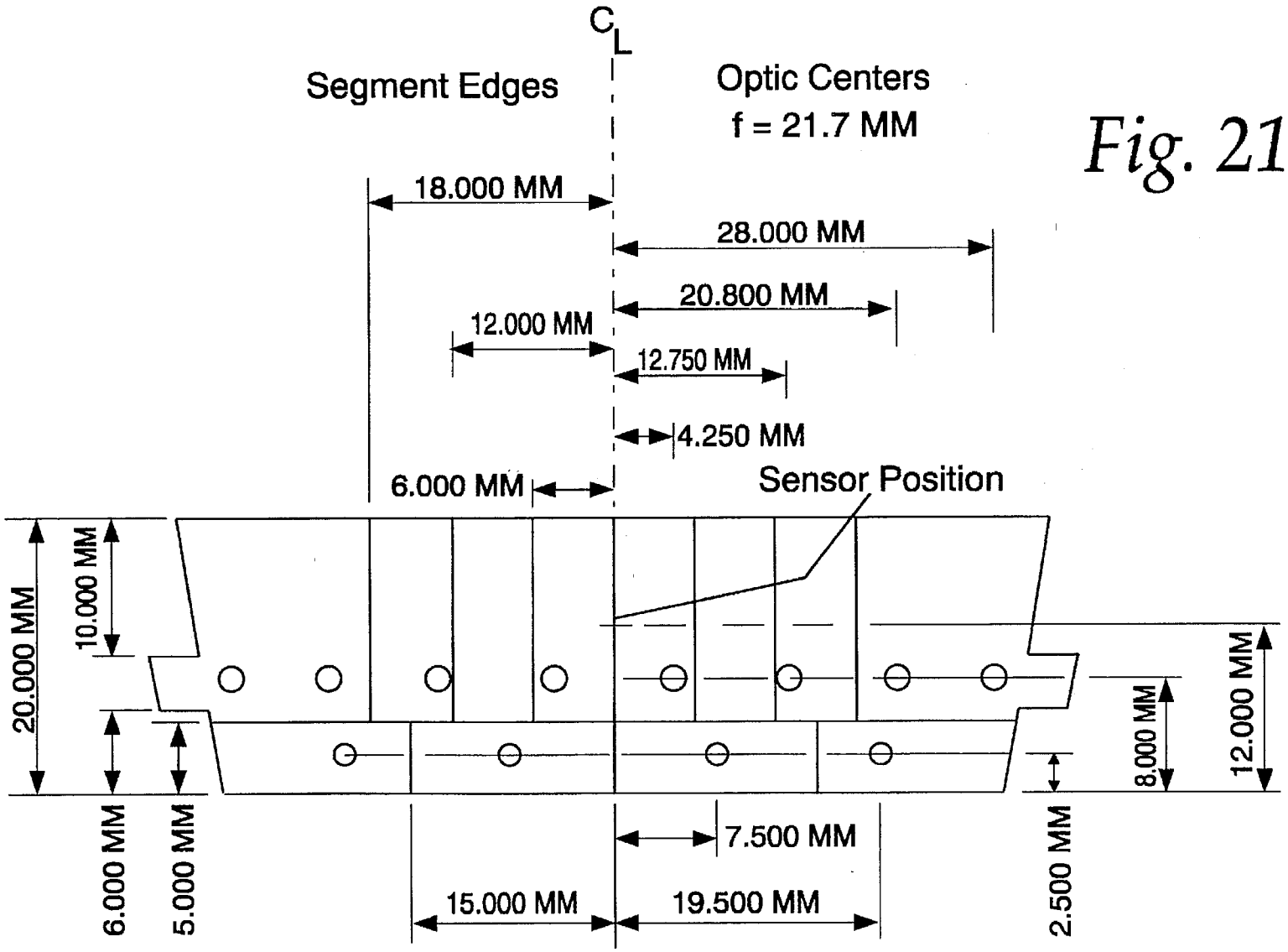
FIG. 21 is a fabrication drawing for a Fresnel lens member in accordance with the preferred embodiment of the invention.

A preferred design for the Fresnel lens 49 is illustrated in FIG. 21. The Fresnel lens 49 may be formed from high-density polyethylene (HDPE) with a thickness of 0.4 mm and formed as illustrated in FIG. 21.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A motion detector assembly adapted to be rigidly secured to a lamp assembly of a coach lantern, the motion detector assembly comprising:

an upper housing portion and a lower housing portion, said lower housing portion formed with an annular window;

a sensor carrier subassembly configured to fit within said housing;

a passive infrared (PIR) sensor for detecting moving sources of infrared radiation, said PIR sensor carried by said sensor carrier subassembly so as to be generally aligned with said annular window and said lower housing portion;

a Fresnel lens member formed from a generally planar material, carried by said sensor carrier subassembly in a generally cylindrical configuration in spaced relation to said annular window and generally aligned with said PIR sensor and said annular window; and a lens cover disposed adjacent to annular window and conforming to the shape of the annular window.

2. A motion detector assembly as recited in claim 1, further including means for securing said lens cover to said sensor carrier assembly.

3. A motion detector assembly as recited in claim 1, wherein said lens cover is formed with tabs and said sensor carrier subassembly is formed with cooperating slots for receiving said tabs to enable said lens cover to be secured to said sensor carrier assembly.

4. A motion detector assembly as recited in claim 1, further including means for securing said Fresnel lens member to said sensor carrier assembly.

5. A motion detector assembly as recited in claim 1, wherein said Fresnel lens is formed with tabs and said sensor carrier subassembly is formed with cooperating slots to enable said Fresnel lens to be secured to said sensor carrier assembly.

6. A motion detector assembly adapted to be rigidly secured to a decorative lamp assembly, the motion detector assembly comprising:

a housing defining a longitudinal axis formed in two portions defining an upper housing portion and a lower housing portion, one of said upper or lower housing portions formed with an annular window;

a sensor carrier subassembly, configured to fit within said housing;

a passive infrared (PIR) sensor having a viewing field, said PIR sensor carried by said sensor carrier subassembly such that said viewing field is generally parallel to said longitudinal axis;

a Fresnel lens member formed from a generally planar material, carried by said sensor carrier subassembly in a generally cylindrical configuration, said Fresnel lens member being disposed generally concentric relative to said longitudinal axis and generally aligned and spaced from said annular window; and a lens cover disposed adjacent to annular window.

7. A motion detector assembly as recited in claim 6, further including means for securing said Fresnel lens to said sensor carrier subassembly.

8. A motion detector assembly as recited in claim 6, further including a lens cover.

9. A motion detector assembly as recited in claim 8, further including means for securing said lens cover to said sensor carrier subassembly.

* * * * *